US008123061B1

(12) United States Patent
Brown

(10) Patent No.: US 8,123,061 B1
(45) Date of Patent: Feb. 28, 2012

(54) REFUSE CONTAINER

(76) Inventor: Charles Kenneth Brown, Evansville, IN (US)

( * ) Notice: Subject to any disclaimer, the term of this patent is extended or adjusted under 35 U.S.C. 154(b) by 698 days.

(21) Appl. No.: 11/801,917

(22) Filed: May 11, 2007

Related U.S. Application Data

(60) Provisional application No. 60/920,216, filed on Mar. 26, 2007.

(51) Int. Cl.
*B65F 1/16* (2006.01)

(52) U.S. Cl. ..... 220/4.33; 220/4.28; 220/908

(58) Field of Classification Search ..... 220/4.33, 220/4.28, 908, 692, 693, 668; 277/650, 637, 277/921

See application file for complete search history.

(56) References Cited

U.S. PATENT DOCUMENTS 3,270,900 A * 9/1966 Sherman ..... 414/303

(Continued)

*Primary Examiner* — Stephen Castellano

(74) *Attorney, Agent, or Firm* — Mark A. Manley; George H. Morgan

(57) ABSTRACT

A refuse container assembled from a kit comprising thermoformed recycled plastic front, left and right, and rear panels, with predrilled holes, a waffled bottom, reinforcement angles, corner angles, castors, assembly hardware, caulking, sealing tape, lifting tubes for a front loading option, and an attachment rod and a swivel eye assembly for a rear loading option.

4 Claims, 16 Drawing Sheets

U.S. PATENT DOCUMENTS

| | | | | | |
|---|---|---|---|---|---|
| 3,589,548 | A | | 6/1971 | Weiss | 220/4 R |
| 3,841,267 | A | | 10/1974 | Miller | 119/5 |
| 3,861,767 | A | | 1/1975 | Mead | 312/250 |
| 4,342,402 | A | * | 8/1982 | Jungles | 220/848 |
| 4,445,623 | A | | 5/1984 | Kolling et al. | 220/343 |
| 4,508,237 | A | | 4/1985 | Kreeger et al. | 220/6 |
| 4,955,501 | A | | 9/1990 | Hodge | 220/315 |
| 4,969,813 | A | | 11/1990 | Lee et al. | 425/503 |
| 5,118,005 | A | * | 6/1992 | Onodera | 220/501 |
| 5,279,436 | A | * | 1/1994 | Elliott et al. | 220/1.5 |
| 5,447,675 | A | | 9/1995 | Kephart | 264/259 |
| 5,544,632 | A | * | 8/1996 | Choate | 123/195 C |
| 5,671,862 | A | | 9/1997 | Cobos | 220/622 |
| 6,073,943 | A | | 6/2000 | Serrault | 280/47.26 |
| 6,161,884 | A | * | 12/2000 | Pearl | 294/1.1 |
| 6,415,495 | B1 | | 7/2002 | Delmerico et al. | 29/434 |
| 6,427,256 | B1 | | 8/2002 | Mullett et al. | 4/456 |
| 7,073,677 | B2 | | 7/2006 | Richardson et al. | 220/4.32 |
| 7,143,905 | B2 | | 12/2006 | Enayati et al. | 220/23.88 |
| 2004/0178196 | A1 | * | 9/2004 | Sholinder | 220/4.33 |

* cited by examiner

REFUSE CONTAINER

CROSS REFERENCES TO RELATED APPLICATIONS

Provisional Application 60/920,216 filed Mar. 26, 2007 with the same title which is hereby incorporated by reference. Applicant claims priority pursuant to 35USC Para. 119 e i.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a thermoformed plastic refuse container that is sold as a kit for assembly by a buyer.

2. Background Information

Condominiums and apartments usually have two or four cubic yard refuse containers for the convenience of collecting refuse from the residents. These refuse containers are commonly of steel which generates considerable noise, usually early in the morning, that is objectionable to residents of condominiums and apartments. Such steel refuse containers are factory assembled, heavy, and costly to ship. Repairs are cumbersome. Metal refuse containers must be rebuilt every few years due to rust damage.

U.S. Pat. No. 3,861,767 discloses one prior art trash container. This container includes plastic and metal parts but is just a container for trash bags and can not be dumped.

U.S. Pat. No. 4,955,501 shows a typical metal trash dumpster that includes means to allow the dumpster to be picked up and dumped into a trash truck for example. This container includes plastic lids but is typical of the prior art dumpsters having the problems of being difficult and expensive to ship as it takes up a large volume, requires frequent rust out repair and is noisy when dumped. In the past only metal containers are strong enough to resist the forces applied by automatic dumping equipment commonly used in trash collection.

As will be seen in the subsequent description of the preferred embodiments of the present invention, the present invention overcomes shortcomings of prior art.

SUMMARY OF THE INVENTION

The present invention in the preferred embodiment is a refuse container assembled from a kit comprising thermoformed plastic front, left and right side, and rear panels with pre-drilled holes, a waffled bottom, metal corner angles, metal reinforcement angles, castors, nuts, bolts, washers, screws, silicone rubber, and butyl tape.

Kit options comprise lifting tubes for a front loading option as well as an attachment rod and a swivel eye assembly for a rear loading option.

Assembly of the refuse container from the kit comprises the following steps:

Step 1:

Place the bottom, waffled side down, on a flat area. Put butyl seal tape around all four outer edges.

Step 2:

Assemble the back panel to the base with screws through pre-drilled holes in the back panel.

Assemble the front panel to the base with screws through the pre-drilled holes in the front panel.

Assemble the side panels to the base with screws through pre-drilled holes in the side panels.

Step 3:

Install the reinforcement angle using the pre-drilled holes with bolts, nuts and washers with the washers on the outside and the hex nuts inside.

Step 5:

Install each lift arm on a side panel using the pre-drilled holes using bolts, nuts and fender washers, with the washers and nuts outside.

Step 6:

Install both lids with the steel rod by sliding the steel rod through the pivot hinges while the lids are set in place.

Secure the steel rod with two cotter pins.

Step 7:

Install the castors on the bottom of the container using the pre-drilled holes with bolts from the inside of the bottom of the container nuts on the outside.

Step 8:

Clean out the inside of the assembled container.

Caulk all seams with 100% clear silicone.

DESCRIPTION OF THE PREFERRED EMBODIMENTS

Figure 1:
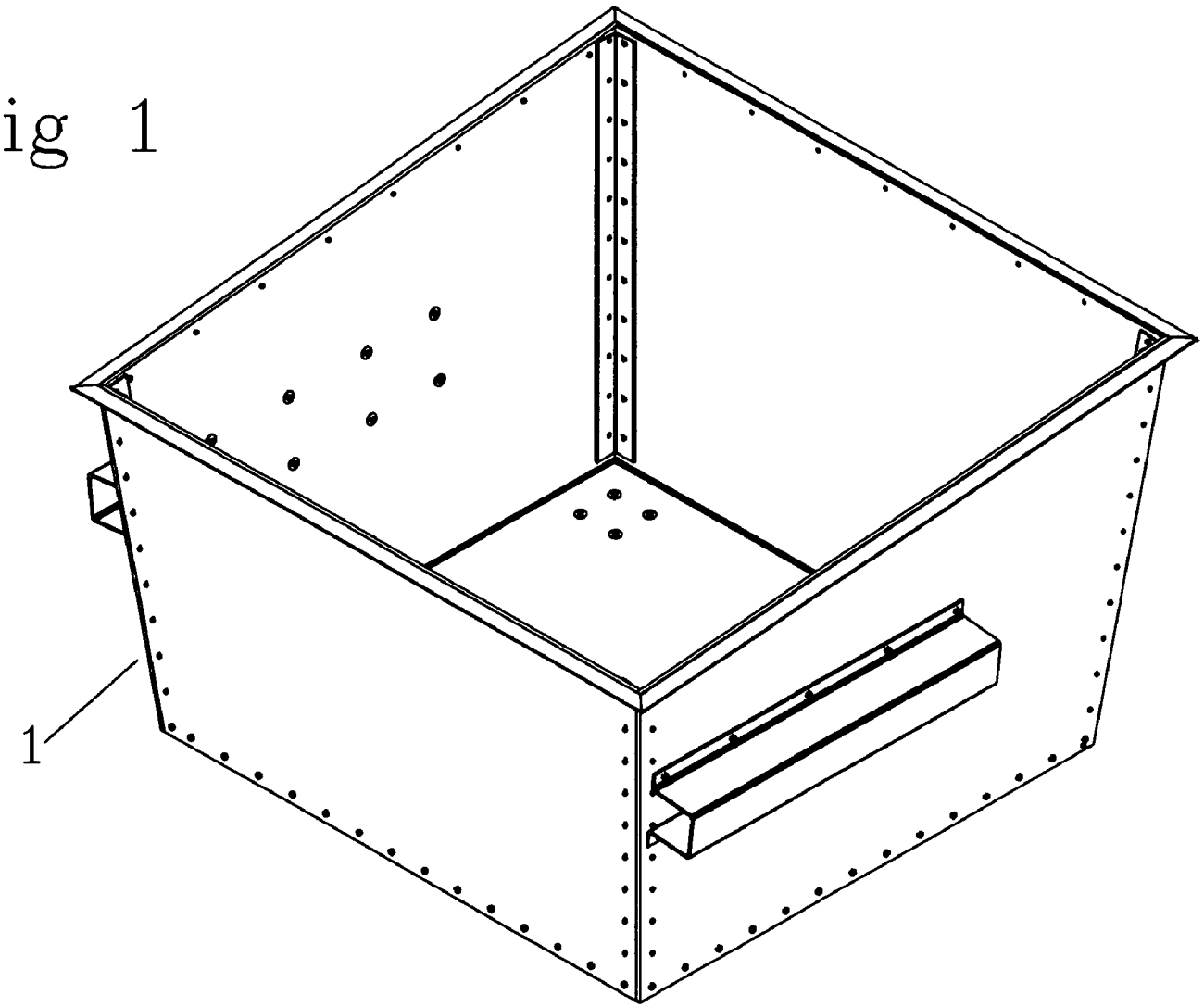
FIGS. 1 through 4 illustrate the preferred embodiment of the present invention, a refuse container.
Figure 2:
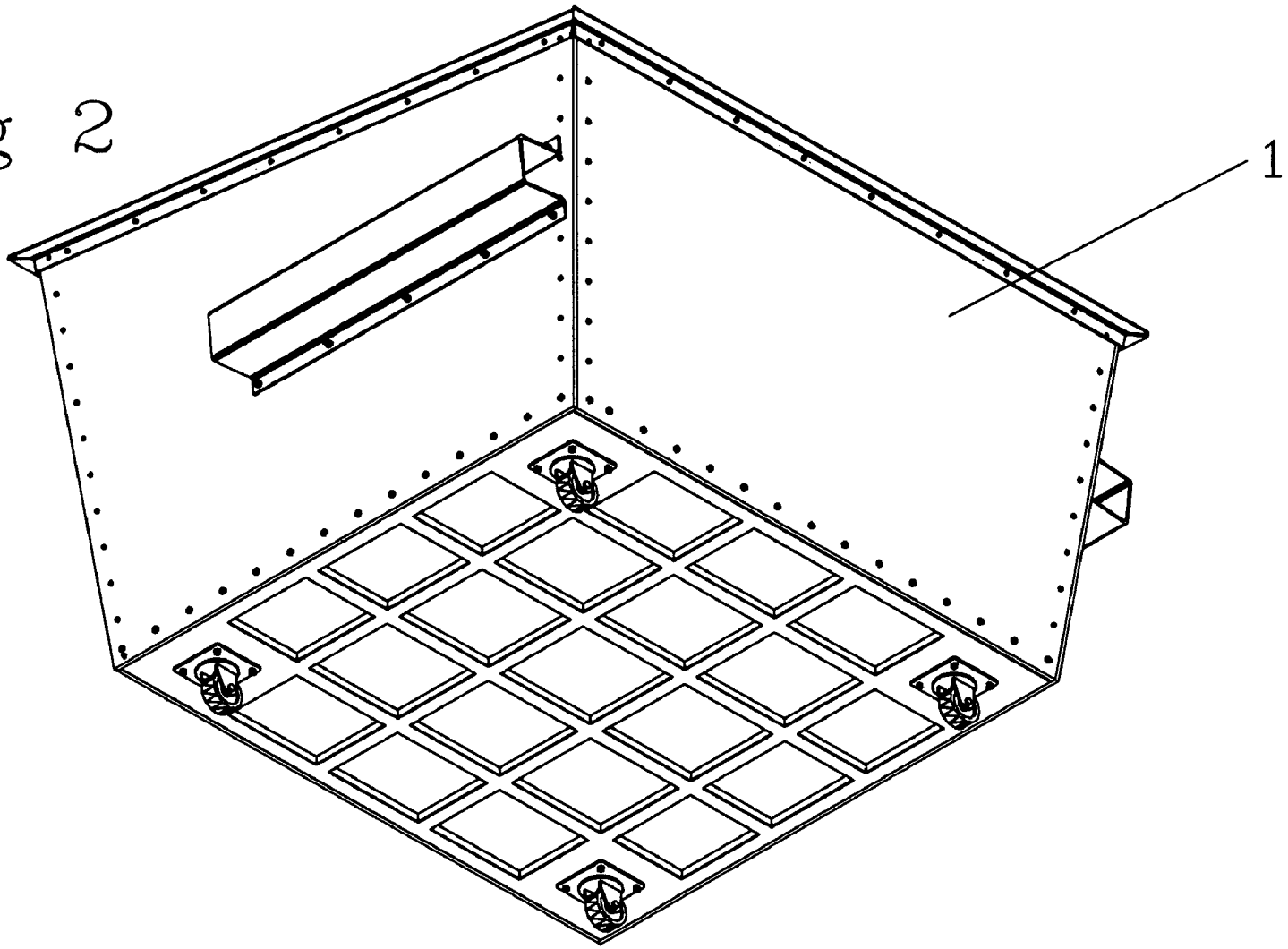
Figure 3:
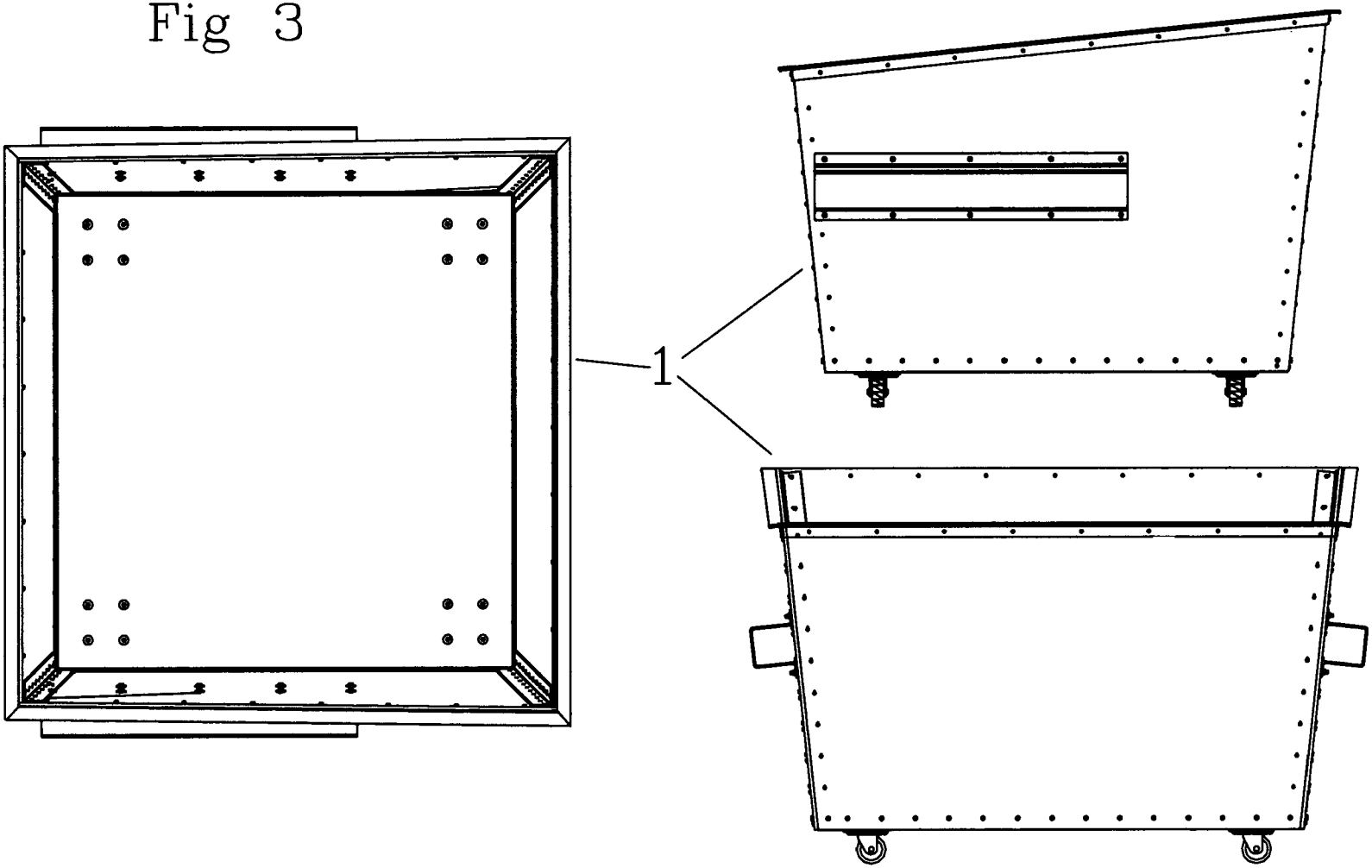
Figure 4:
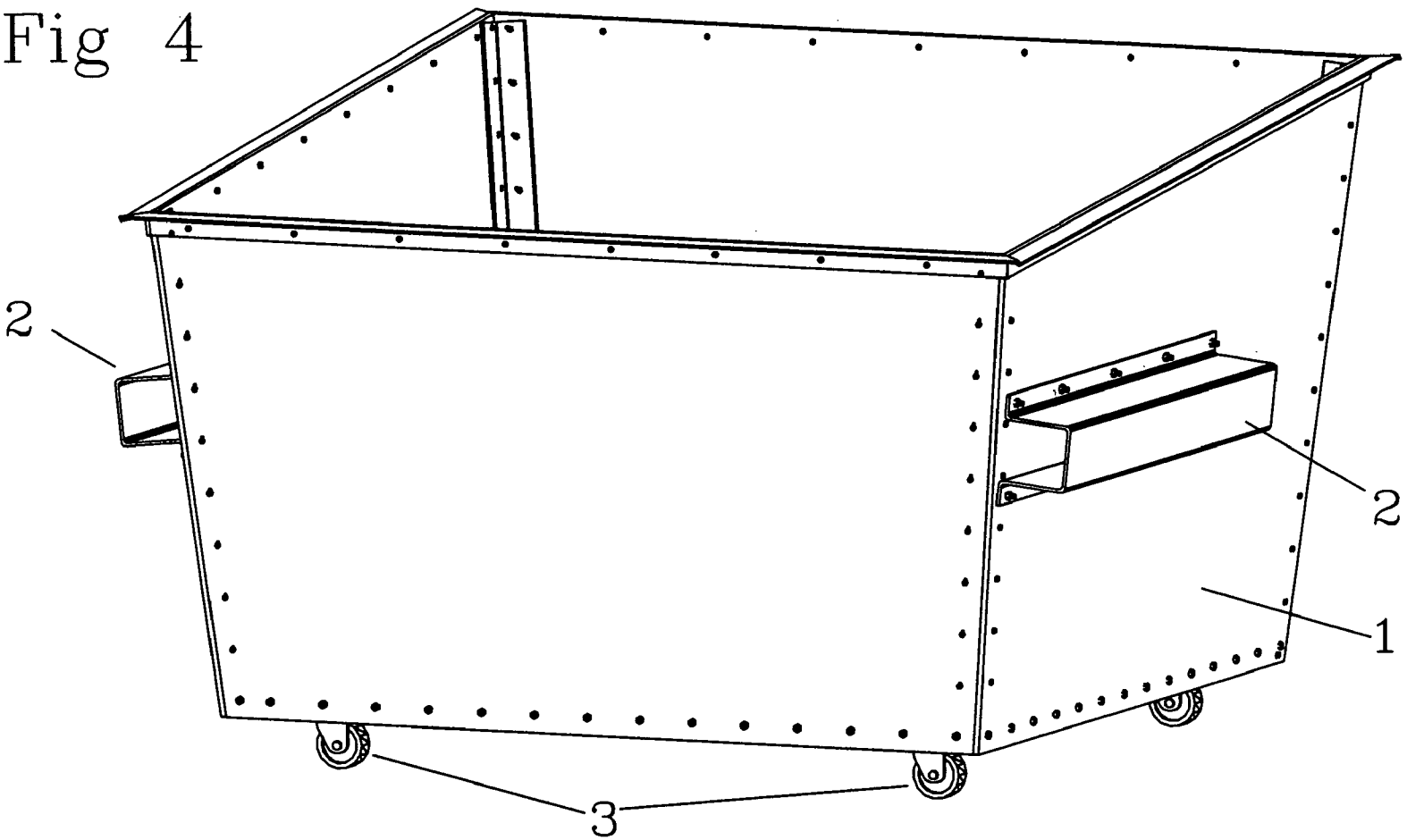
Figure 5:
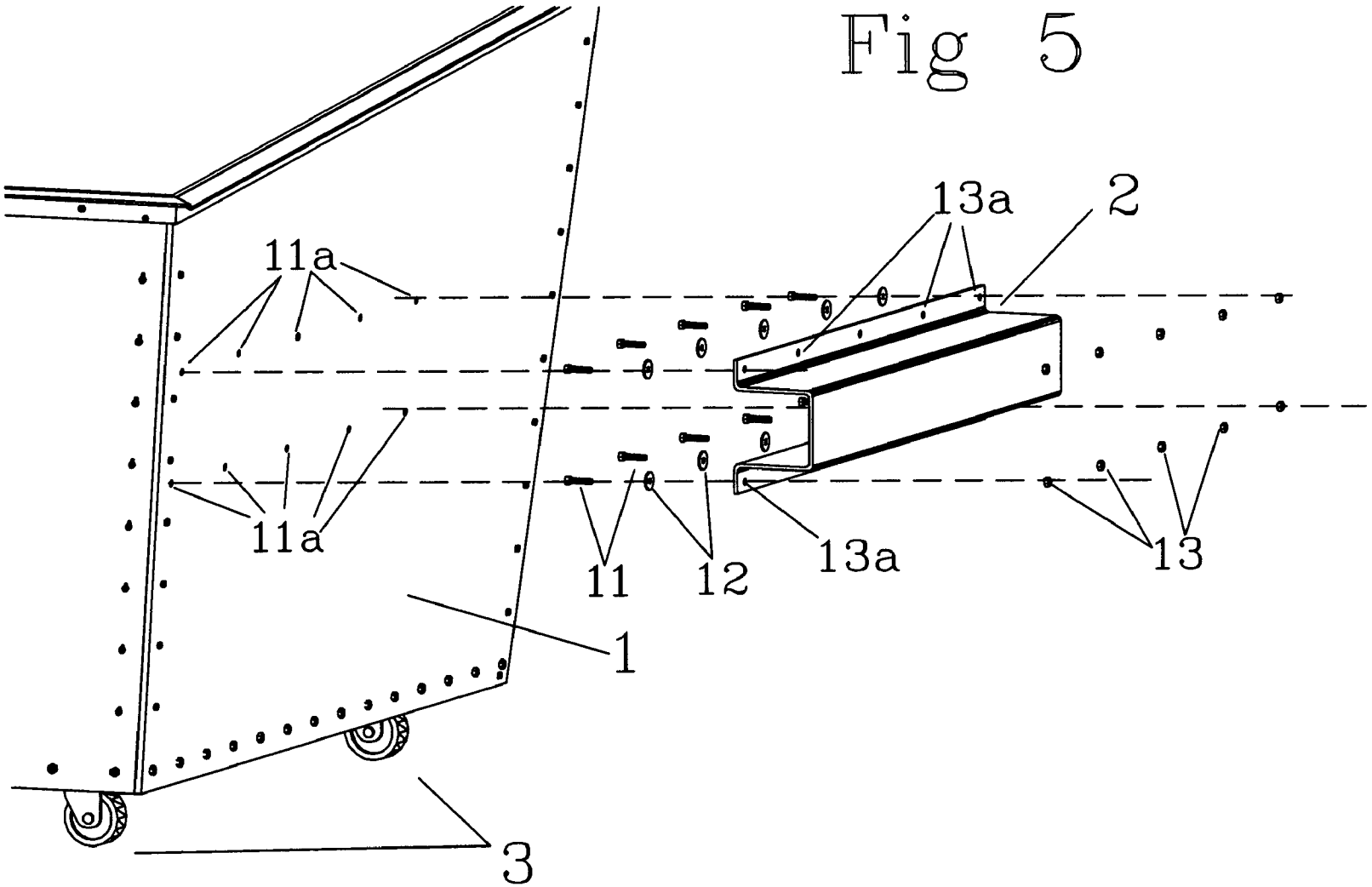
FIGS. 5, through 11 are exploded views illustrating details of the refuse container.

Referring to FIGS. 1 through 4, 13, and 14, the preferred embodiment of the present invention, is a refuse container 1 comprising lifting tubes 2, castors 3, lids 42 with pivot apertures 46, a mounting hinge plate 43 with hinge plate bolt clearances 47*a*, a hinge pin 44, and pivot hinges 45.

Referring also to FIGS. 5 through 12, 15, and 16, the refuse container 1 further comprises a front panel 20 with reinforcement angle bolt clearances 16*a*, front panel bolt clearances 20*a* and screw clearances 25*a*; a left panel 21 with lift arm bolt clearances 11*a*, reinforcement angle bolt clearances 16*a*, left panel bolt clearances 21*a* and screw clearances 25*a*; a rear panel 22 with swivel eye bolt clearances 34*a*, reinforcement angle bolt clearances 16*a* rear bolt clearances 22*a* and screw clearances 25*a*, a right panel 23 with lift arm bolt clearances 11*a*, reinforcement angle bolt clearances 16*a*, right panel bolt clearances 23*a* and screw clearances 25*a*; and a bottom 24 with waffles 41 and caster bolt clearances 38*a*.

The refuse container further comprises sealing tape 24*a*, mounting hinge plate bolts 47, mounting hinge plate nuts 48, lifting tube bolts 11, lifting tube washers 12, lifting tube nuts 13, reinforcement angles 14 with angle bolt clearances 15*a*, reinforcement angle nuts 15, reinforcement angle bolts 16, bottom attachment screws 25, a right front corner angle 26, a right rear corner angle 27, a left rear corner angle 28, a left front corner angle 29, corner angle bolts 30, corner angle nuts 31, a rear loading attachment rod 32 which is welded to the front panel 20 reinforcement angle 14 when rear loading will be encountered, a bolt on swivel eye assembly 33 with a swivel eye 37 that swings upward when the refuse container 1 is loaded from the rear, swivel eye bolts 34, swivel eye washers 35, swivel eye nuts 36, castor bolts 38, castor washers 39, castor nuts 40, bolts 47 for mounting the hinge plate 43, and seams 49.

Figure 6:
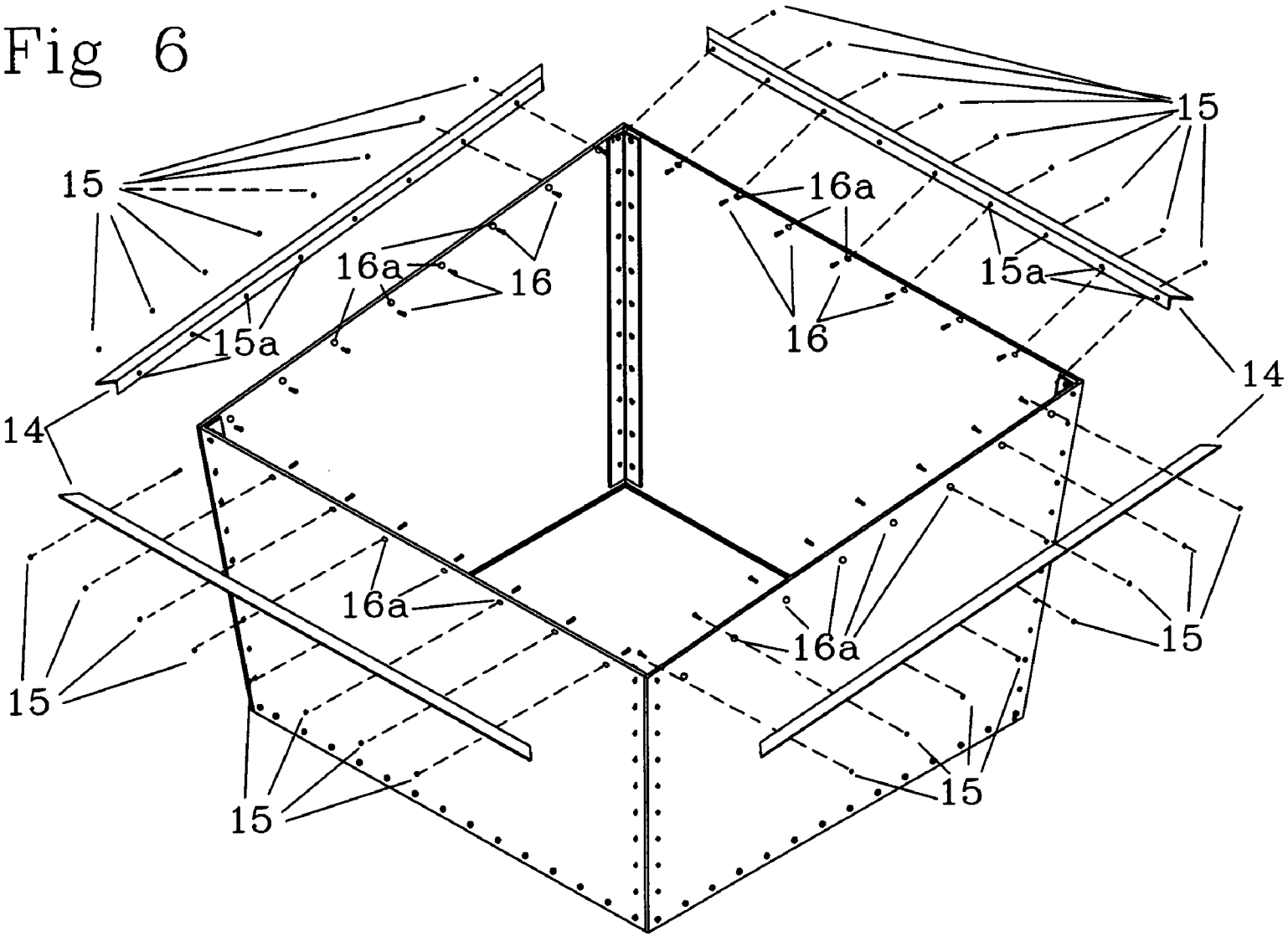
Figure 7:
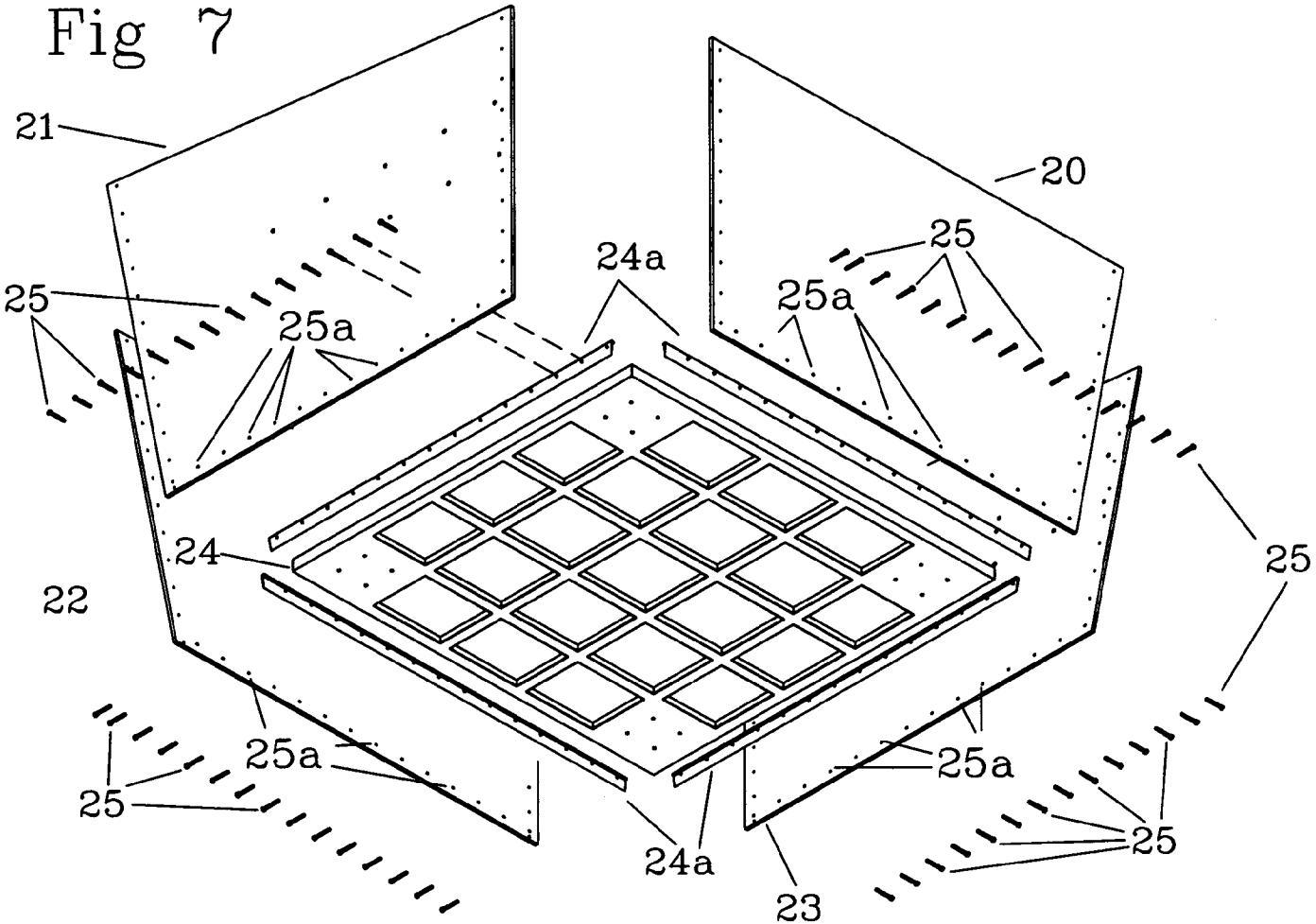
Figure 8:
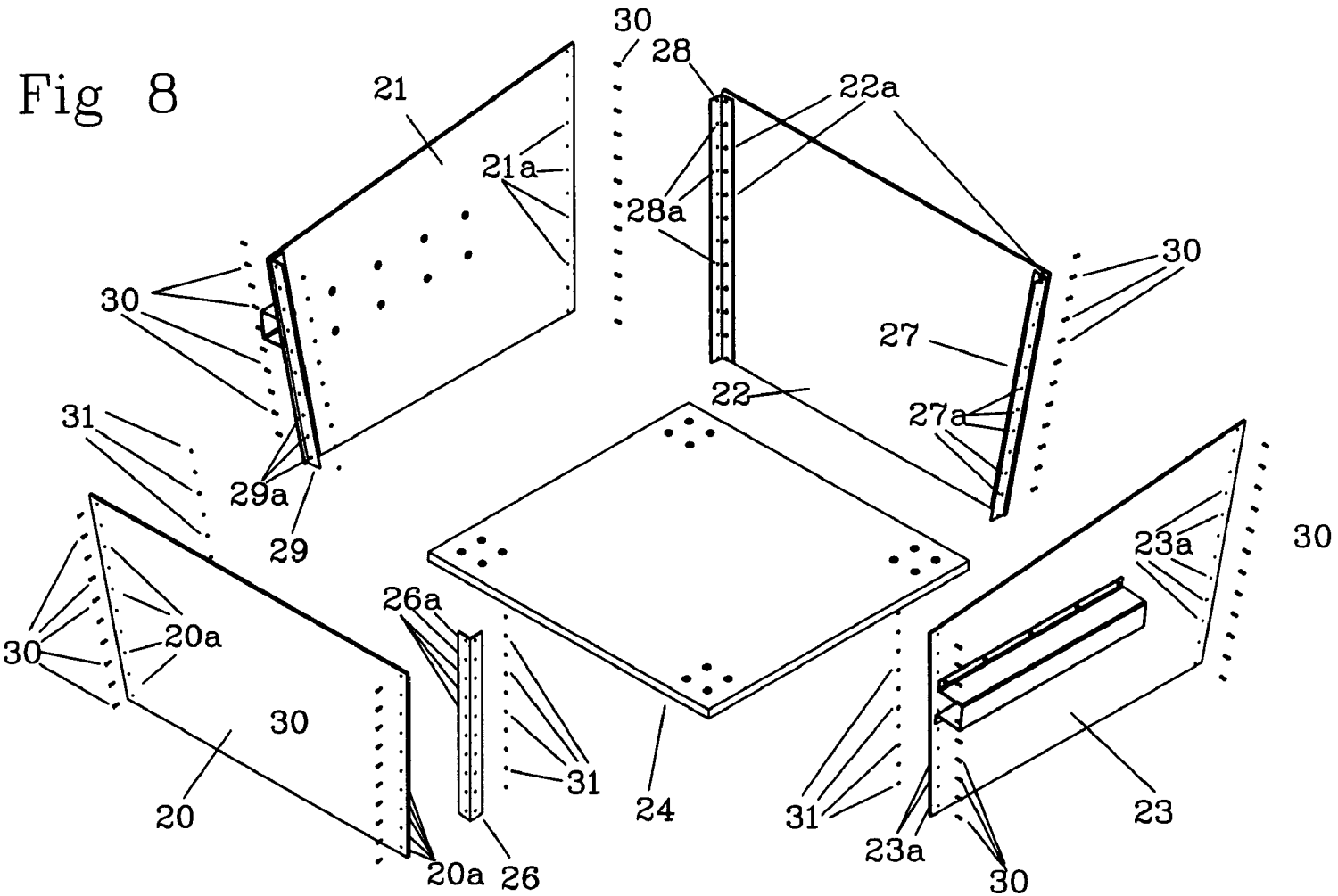
Figure 9:
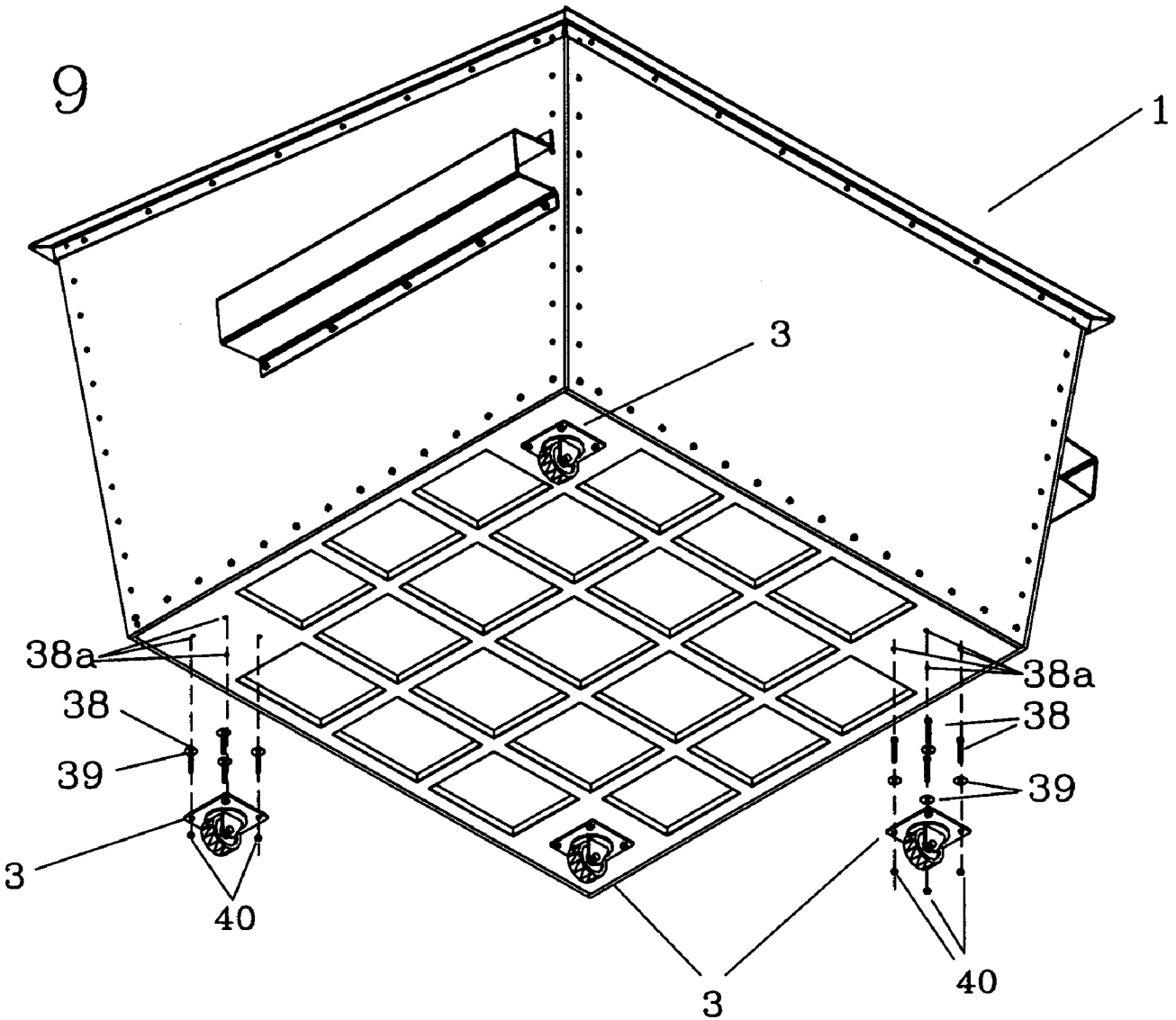
Figure 10:
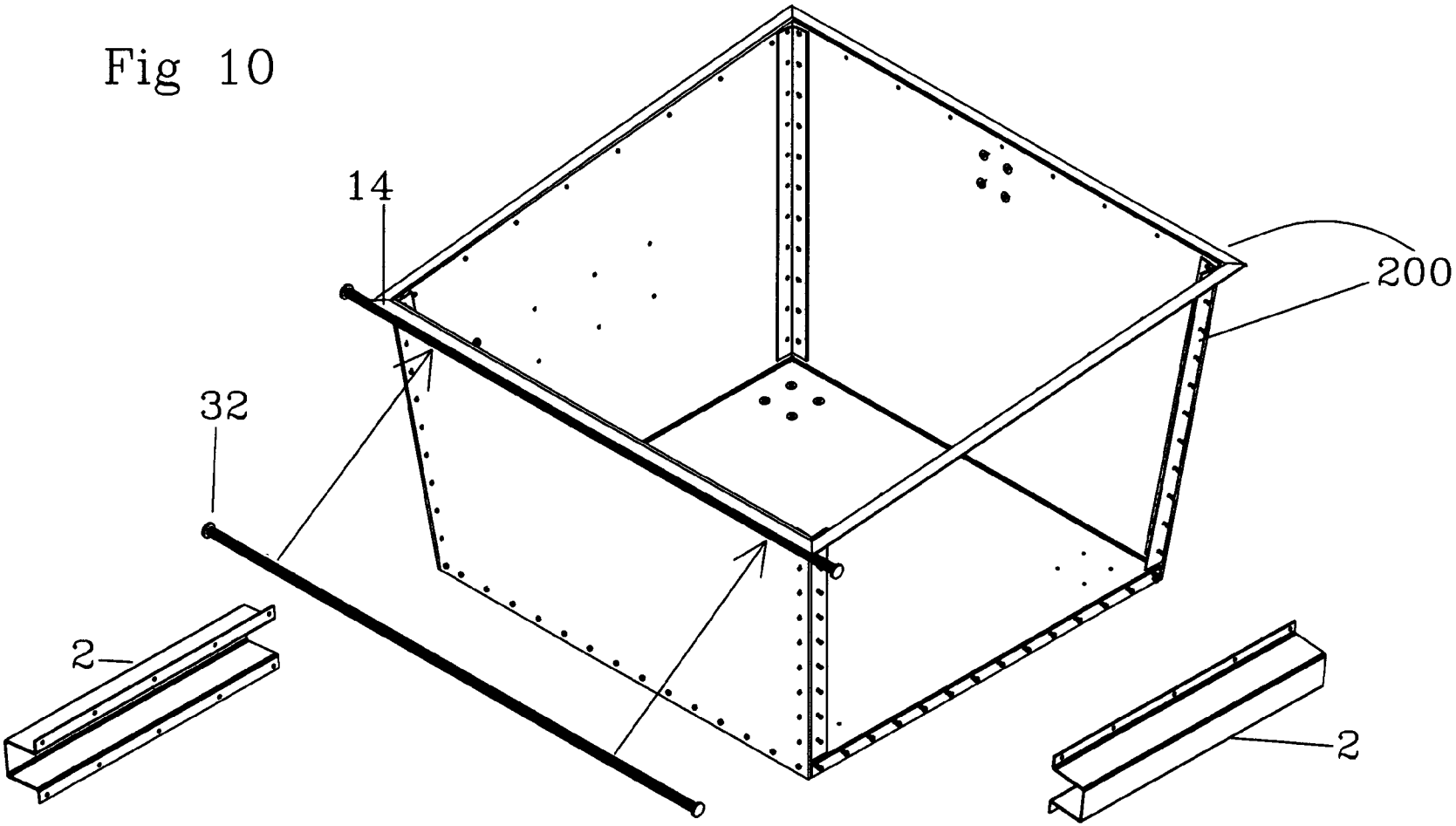
Figure 11:
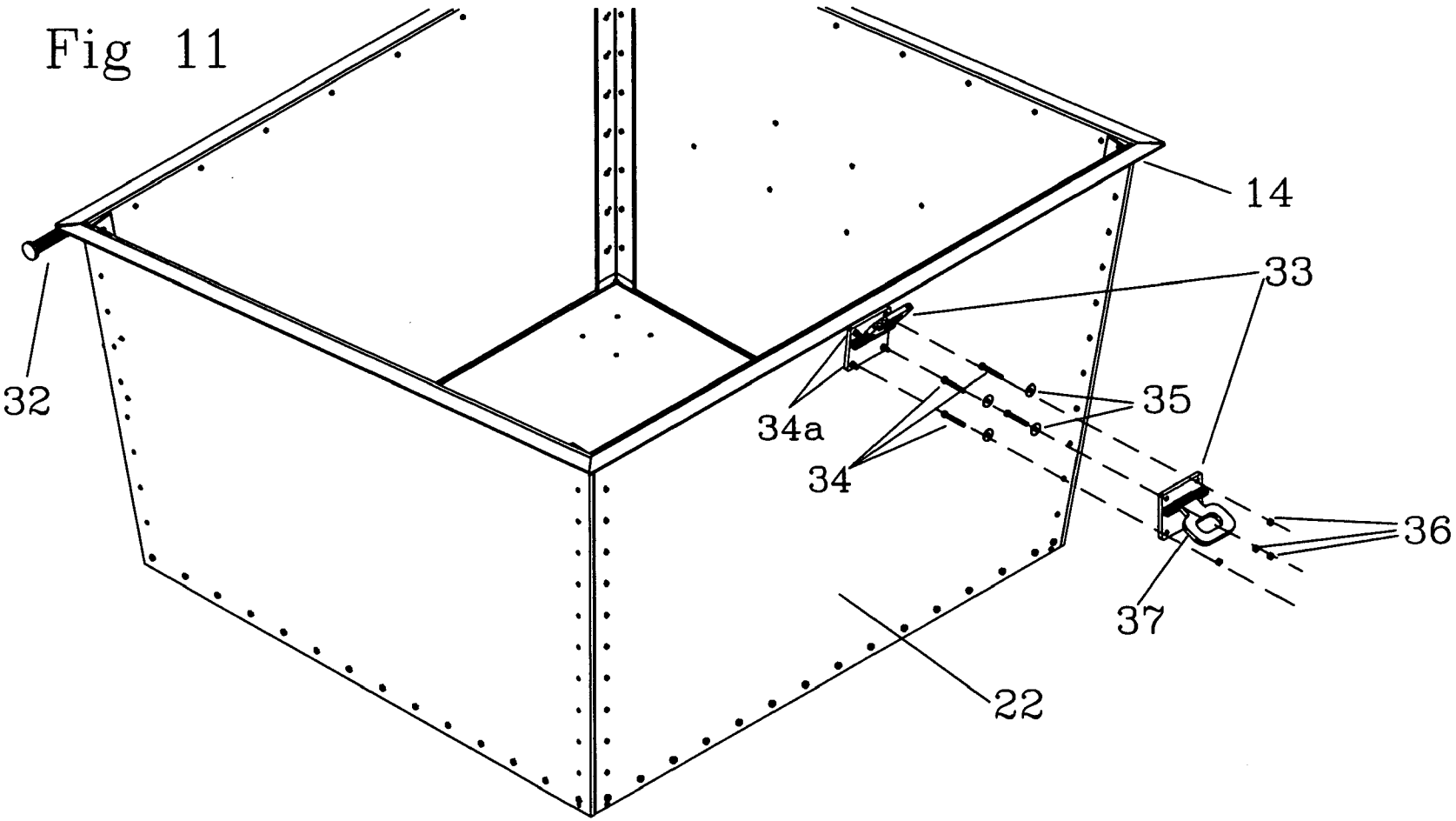
Figure 12:
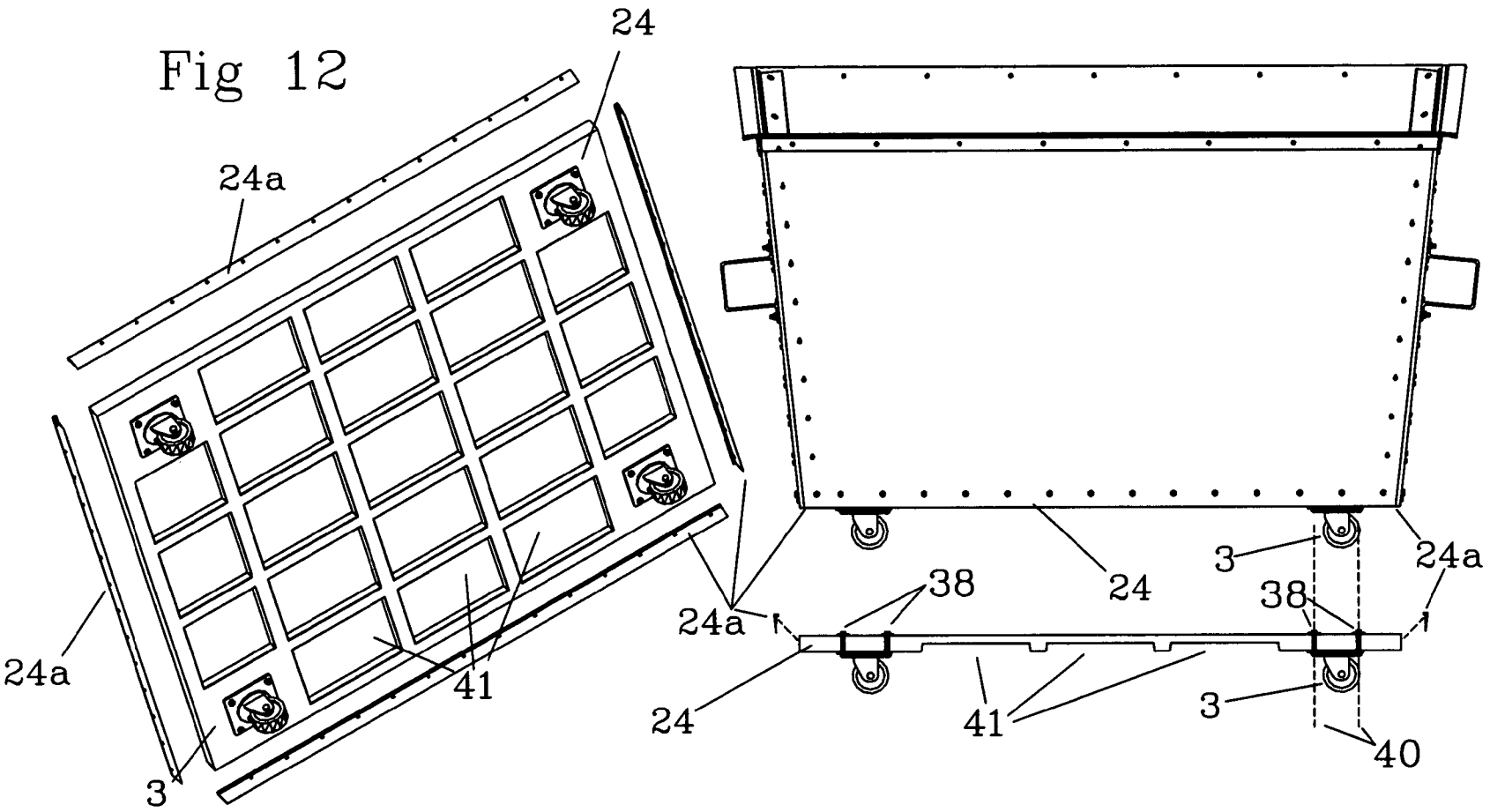
FIGS. 12 through 16 are additional views and details of the refuse container.
Figure 13:
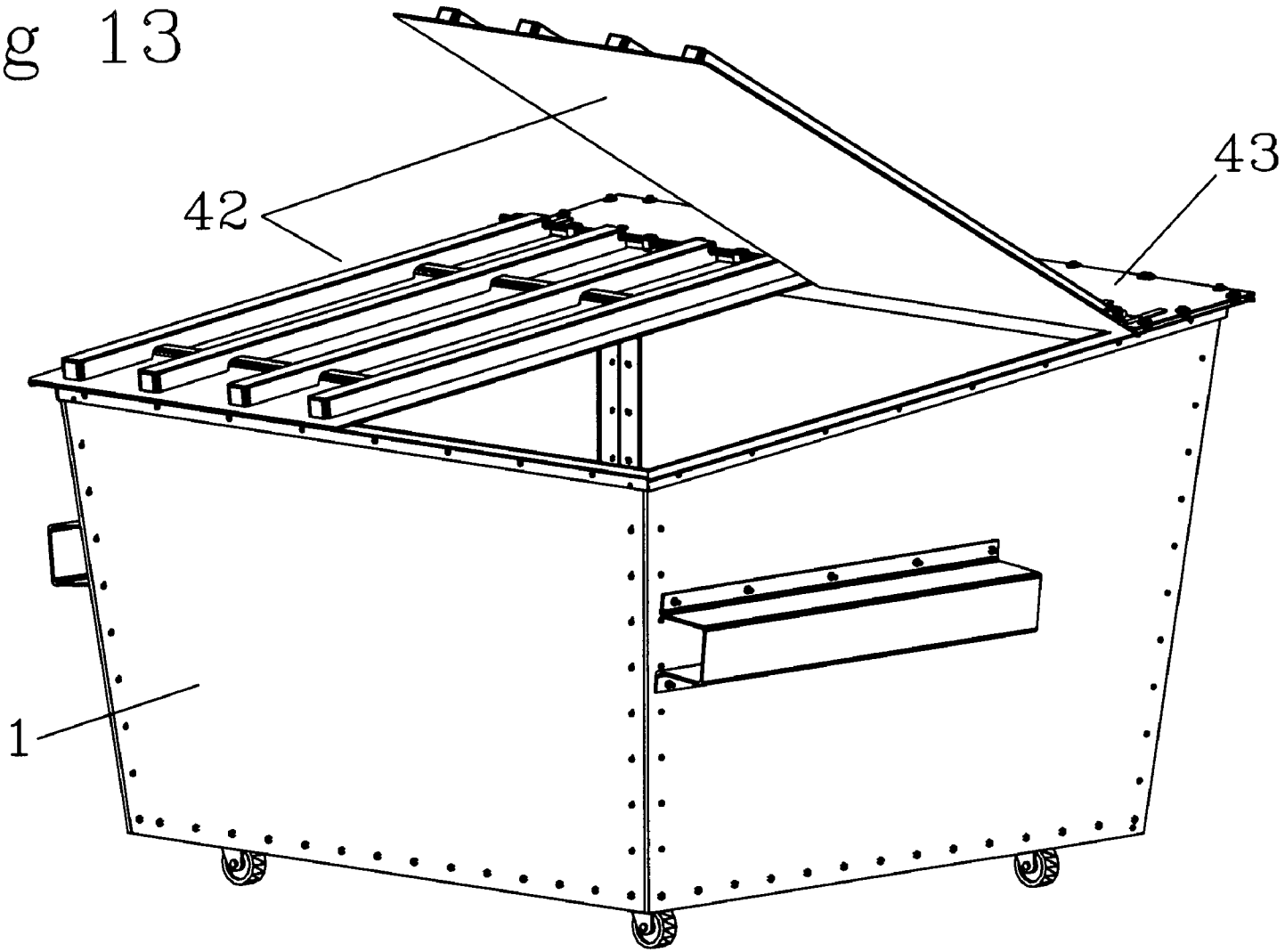
Figure 14:
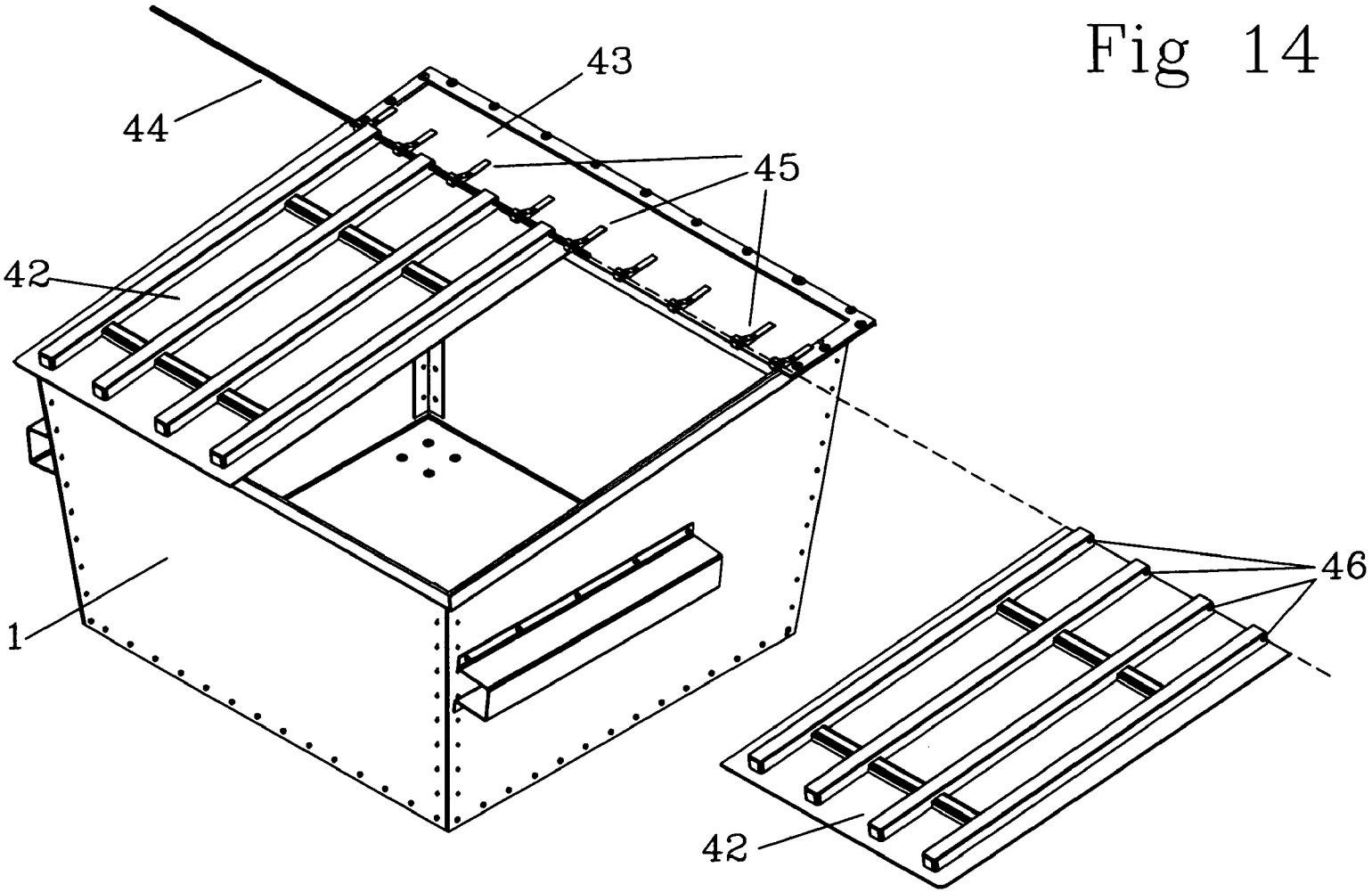
Figure 15:
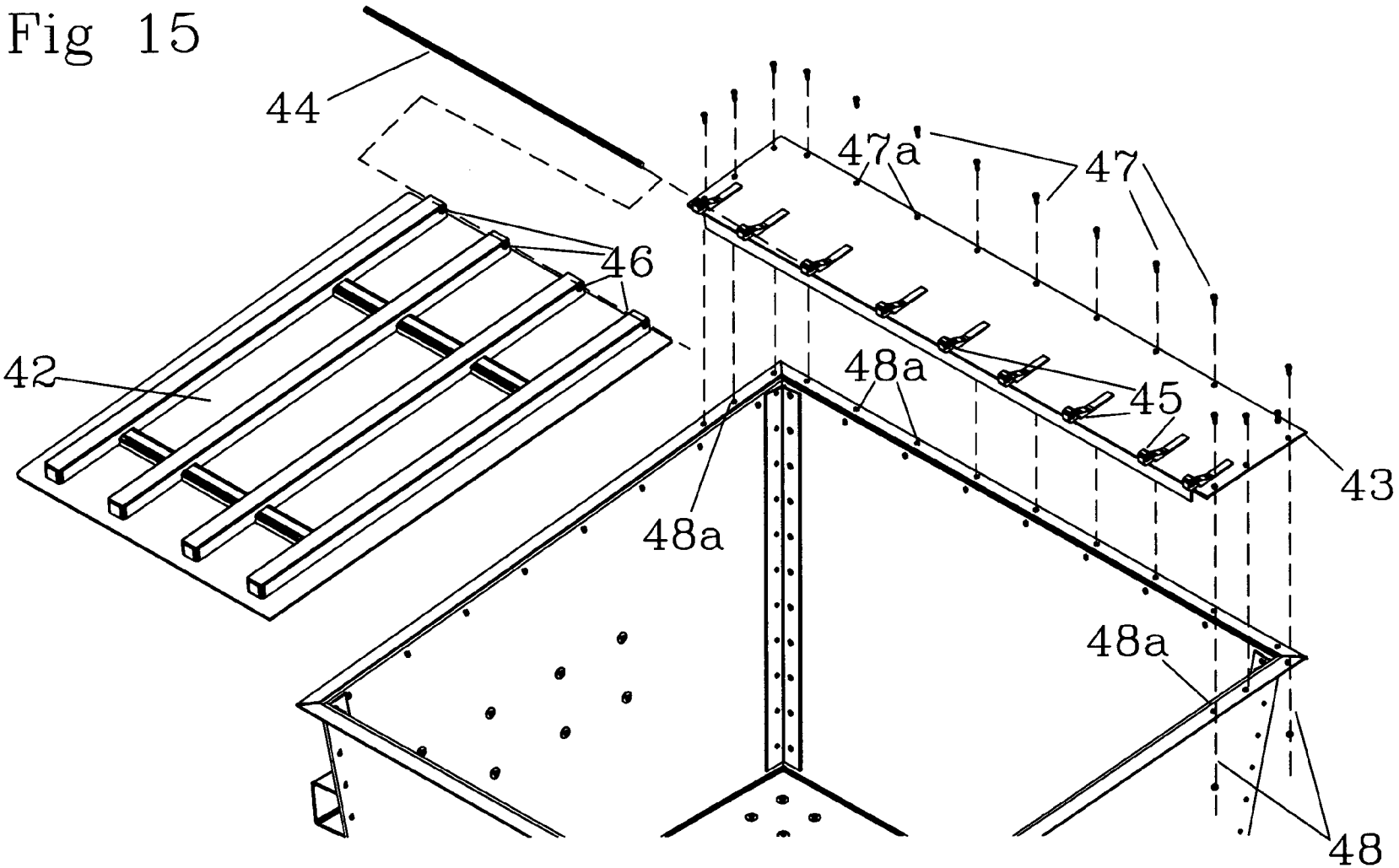
Figure 16:
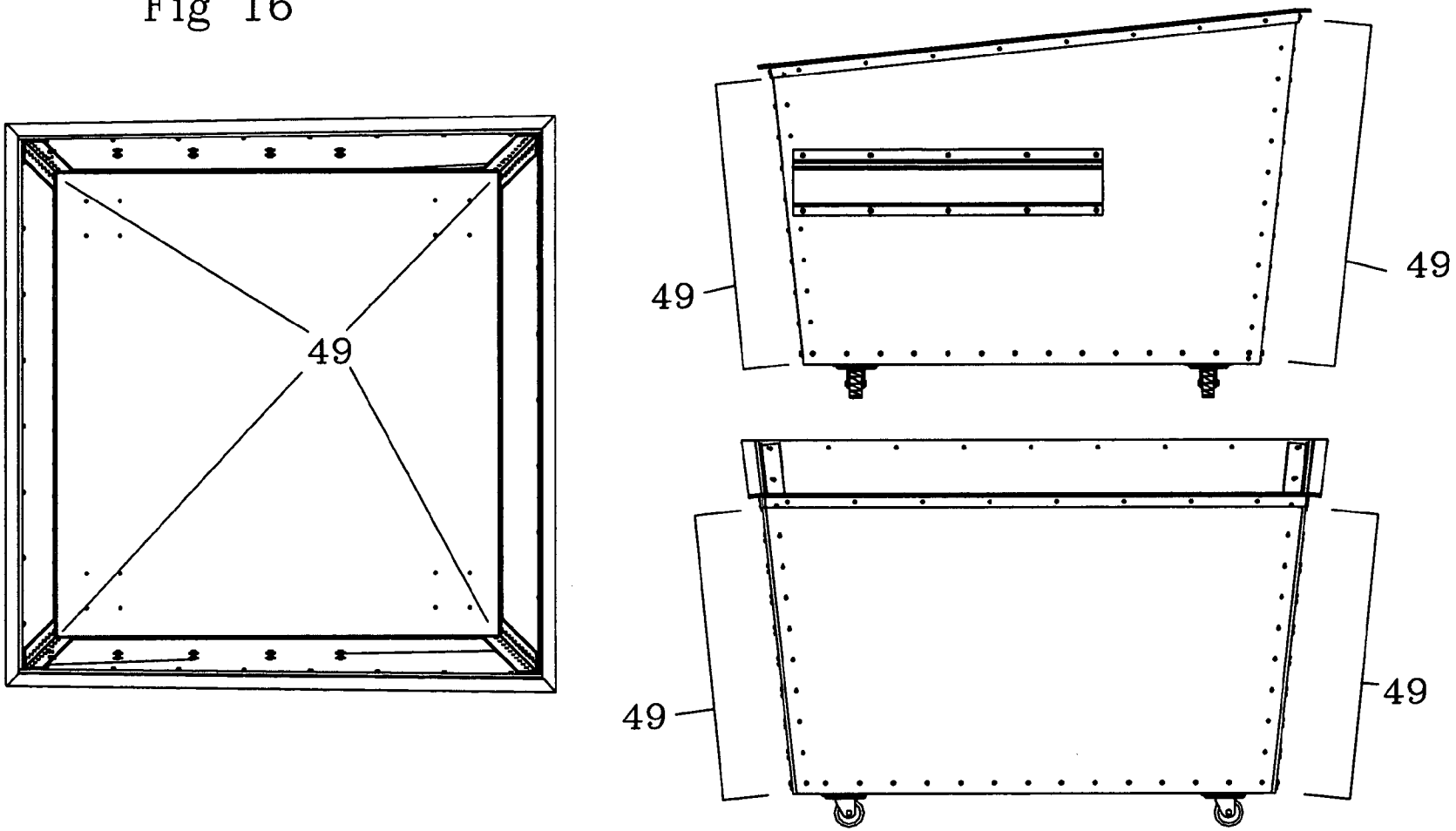

Referring to FIGS. 6, 8 and 15, the hinge panel 43 is bolted through clearances 48*a* that are only in the reinforcement angle 14 attached to the rear panel 22.

In the preferred embodiment of the present invention, the sealing tape 24*a* is a butyl tape. However, as obvious to anyone skilled in the art, other materials might well do the job.

In the preferred embodiment of the present invention said panels 20, 21, 22, and 23 as well as the bottom 24 are thermoformed from recycled plastic from Post Consumer HDPE Comingled Bails. The recycled plastic used includes at least some post consumer High Density Poly Ethylene (HDPE) that have previously been delivered to a customer and then collected for recycle.

Typical recycled plastic material might include the following approximate by weight quantities; 10% dairy containers, 5% PET, 5 PVC, 2 PP, 3% shopping bags. The density of a commingled bail of recycled plastic might be 0.984-0.955 and MI of 0.4-0.9.

In the preferred embodiment of the present invention, the corner angles 26, 27, 28, and 29 as well as the reinforcement angles 14 are of metal, preferably of steel. The metal angles 14, 26 27, 28 and 29 form a framework 200 when assembled that lends strength to the container 1. The metal framework 200 makes the container 1 strong enough to withstand the forces applied to it during unloading by typical front or rear loading trash trucks. The lift bar 32 is welded to the angle 14 directly attaching it to this framework 200.

In the preferred embodiment of the present invention, the refuse container 1 is shipped as a kit, to be assembled by a customer, with said bolt clearances 13*a*, 15*a*, 16*a*, 20*a*, 21*a*, 22*a*, 23*a*, and 34*a* for said bolts 11, 16, 30, 34, 38 and 43 as well screw clearances 25*a* as required in said panels 20,21, 22, and 23 and the bottom 24. The panels 20,21,22,23, bottom 24 and lids 42 will pack flat and thus many kits can be shipped in the volume that would normally be taken up by a single container.

Assembly of the refuse container 1 comprises the following
steps:

Step 1:

Place the bottom 24 on a flat area (FIG. 7), with the waffles 41 adjacent to the flat area. Put the sealing tape 24*a* around the bottom 24 to serve as a seal between the bottom 24 and said panels 20, 21, 22, and 23.

Step 2:

Attach the rear panel 22 to the bottom 24 with the bottom attachment screws 25 through the predrilled screw clearances 25*a* in the rear panel 22. Attach the front panel 20 to the bottom 24 with the bottom attachment screws 25 through the predrilled screw clearances 25*a* in the front panel 20.

Attach the left panel 21 to the bottom 24 with the bottom attachment screws 25 through the predrilled screw clearances 25*a* in the left panel 21.

Attach the right panel 23 to the bottom 24 with the bottom attachment screws 25 through the predrilled screw clearances 25*a* in the right panel 23.

Step 3:

(FIGS. 7 and 8) Bolt in place said corner angles 26, 27, 28, and 29 to the panels 20, 21, 21, and 23, using the corner angle bolts 30 and the corner angle nuts 31. The nuts 31 go in the interior of the refuse container 1. Use washers (not shown) between the nuts 31 and said panels 20, 21, 22, and 23.

Step 4:

Bolt the reinforcement angles 14 to said panels 20, 21, 22, and 23 using the reinforcement angle bolts 16 and the reinforcement angles nuts 15 through the predrilled clearances in the reinforcement angles 14. The reinforcement angle 14 with the most the clearances 48*a* in addition to said clearances 15*a* is attached to the rear panel 23. The nuts 15 go on the interior of the refuse container 1. Use a flat washer under the nuts 15. The two reinforcement angles with a relatively few the clearances 48*a* in addition to the clearances 15*a* are attached to the left and right panels 21 and 23, with the clearances 48*a* adjacent to the rear panel 22.

If rear loading will be used, attach, such as by welding, the rear loading attachment rod 32 to the front panel 20 reinforcement angle 14 and attach the swivel eye assembly 32 to the rear panel 22 using the swivel eye bolts 34, the swivel eye washers 35, the swivel eye nuts 36 and the swivel eye bolt clearances 34*a* in the rear panel 22.

Step 5:

Install the lifting tubes 14 on panels 21 and 23, using the lifting tube bolt clearances 11*a*. The lifting tube bolts 11, the lifting tube washers, 12, and the lifting tube nuts 13. The washers 12 and nuts 13 go in the interior of the refuse container 1.

Step 6:

Attach the hinge plate 43 using the hinge plate bolts 47 through the hinge plate bolt clearances 47*a* and angle bolt clearances 48*a* in the reinforcement angles 14 together with the hinge plate nuts 48.

Step 7:

Install the lids 42 with the rear loading attachment rod 32 by sliding said rod 44 through the pivot hinges 45 while the lids 42 are set in place.

Secure the rod 44 with two cotter pins (not shown).

Step 8:

Attach the castors 3 (FIG. 9) using the castor bolt clearances 38*a* in the bottom 24, the castor bolts 38, castor washers 39, and castor nuts 40.

Step 9:

Clean out the refuse container 1.

Caulk all seams 49 with 100% clear silicone

Although the description above contains many specificities,
these should not be construed as limiting the scope of the invention but as merely providing illustrations of some of the presently preferred embodiments of this invention.

It will be obvious to those skilled in the art that modifications may be made to the embodiments described above without departing from the scope of the present invention.

Thus the scope of the invention should be determined by the
appended claims in the formal application and their legal equivalents, rather than by the examples given.

I claim:

1. A refuse container comprising:

a) flat recycled plastic panels, wherein each panel is a single sheet of flat material containing at least some recycled material;

b) a recycled plastic waffled bottom;

c) metal corner angles; and d) reinforcement angles;

wherein the recycled plastic panels have predrilled holes permitting field assembly;

wherein the flat recycled plastic panels are connected together by metal corner angles and reinforcement angles forming a metal framework;

a rod welded to said framework facilitating rear loading, wherein the flat recycled panels include side panels, lift arms bolted to the side panels to facilitate emptying of the container by lifting to a dump position and a pivotable lid on the container.

2. The refuse container of claim 1 further comprising a swivel eye, attached adjacent an upper portion of said metal frame, to facilitate rear loading.

3. A refuse container comprising:

a) recycled predominantly flat plastic panels containing at least 25% post consumer waste;

b) a recycled waffle bottom;

c) metal corner angles; and d) metal reinforcement angles;

wherein the recycled flat plastic panels have predrilled holes permitting field assembly;

wherein the recycled flat plastic panels are connected together by the metal corner angles and reinforcement angles forming a metal framework and a lift rod attached to the metal framework to facilitate emptying of the container by lifting to a dump position wherein the flat panels include side panels, a front panel, and a rear panel, lift arms bolted to the side panels to facilitate emptying of the container by lifting to a dump position and a pivotable lid on top of the container.

4. The refuse container of claim 3 further comprising a swivel eye attached adjacent the metal framework to facilitate rear loading.

* * * * *